US010245459B1

(12) United States Patent
Cranke

(10) Patent No.: US 10,245,459 B1
(45) Date of Patent: Apr. 2, 2019

(54) SPORTS TRAINING SYSTEM AND METHOD

(71) Applicant: Christopher Tolbert Cranke, Upper Marlboro, MD (US)

(72) Inventor: Christopher Tolbert Cranke, Upper Marlboro, MD (US)

( * ) Notice: Subject to any disclaimer, the term of this patent is extended or adjusted under 35 U.S.C. 154(b) by 71 days.

(21) Appl. No.: 15/475,019

(22) Filed: Mar. 30, 2017

Related U.S. Application Data

(60) Provisional application No. 62/315,108, filed on Mar. 30, 2016, provisional application No. 62/329,363, filed on Apr. 29, 2016, provisional application No. 62/358,766, filed on Jul. 6, 2016, provisional application No. 62/437,441, filed on Dec. 21, 2016.

(51) Int. Cl.

| | |
|---|---|
| ***A43B 5/06*** | (2006.01) |
| ***A43C 1/04*** | (2006.01) |
| ***A63B 21/00*** | (2006.01) |
| ***A63B 21/04*** | (2006.01) |
| ***A63B 23/04*** | (2006.01) |
| ***A63B 69/00*** | (2006.01) |
| ***A63B 21/055*** | (2006.01) |

(52) U.S. Cl.
CPC ..... *A63B 21/0557* (2013.01); *A43B 5/06* (2013.01); *A43C 1/04* (2013.01); *A63B 21/0407* (2013.01); *A63B 21/4009* (2015.10); *A63B 21/4015* (2015.10); *A63B 21/4039* (2015.10); *A63B 21/4043* (2015.10); *A63B 23/0405* (2013.01); *A63B 69/0028* (2013.01)

(58) Field of Classification Search
CPC ..... A41D 2200/10; A41F 9/00–9/005; A41F 9/02–9/025; A63B 21/02; A63B 21/04–21/0407; A63B 21/0428; A63B 21/055–21/0557; A63B 21/4001; A63B 21/4009; A63B 21/4013–21/4015; A63B 69/0028; A63B 69/0035
See application file for complete search history.

(56) References Cited

U.S. PATENT DOCUMENTS

| | | | |
|---|---|---|---|
| 807,908 | A | 12/1905 | Bradstreet |
| 1,548,711 | A | 8/1925 | Cooper |
| 2,097,376 | A | 10/1937 | Marshman |

(Continued)

FOREIGN PATENT DOCUMENTS

| | | | |
|---|---|---|---|
| EP | 2844356 | A1 | 3/2015 |
| WO | 1996033609 | A1 | 10/1996 |
| WO | 2005027685 | A2 | 3/2005 |

*Primary Examiner* — Jennifer M Deichl
(74) *Attorney, Agent, or Firm* — Quickpatents, LLC; Kevin Prince

(57) ABSTRACT

A physical training system includes a belt for fixing around the waist of a person and that includes a plurality of belt extension straps each adapted for fixing with the belt at any location therearound and preferably adjustable in length. Two shoes are adapted for wearing on the person's feet, each shoe including at least four attachment loops at opposing quadrants of the shoe and optional shoe extension straps. A plurality of elastomeric bands are selectively fixable between any of the belt extensions straps and the attachment loops or shoe extension straps of the shoes. As such, in use, the person while running experiences resistance as each leg extends into a fully extended position, and a reduction or cessation of resistance as each leg retracts into a non-extended position.

18 Claims, 7 Drawing Sheets

(56) References Cited

U.S. PATENT DOCUMENTS

| | | | | |
|---|---|---|---|---|
| 3,162,441 | A | 12/1964 | Laddie | |
| 5,188,365 | A * | 2/1993 | Picard | A63B 69/0059 473/212 |
| 5,203,754 | A | 4/1993 | Maclean | |
| 5,306,222 | A * | 4/1994 | Wilkinson | A41D 13/0015 482/121 |
| 5,464,136 | A | 11/1995 | Eddy | |
| 5,619,819 | A | 4/1997 | Hauschild | |
| 5,716,307 | A | 2/1998 | Vadher | |
| 5,993,362 | A | 11/1999 | Ghobadi | |
| 6,287,242 | B1 | 9/2001 | Fray | |
| D606,602 | S | 12/2009 | Marotta | |
| 7,628,742 | B2 | 12/2009 | Weaver | |
| 7,744,511 | B2 * | 6/2010 | Grigoriev | A61F 5/0102 482/121 |
| 7,874,970 | B2 * | 1/2011 | Glisan | A63B 21/0552 482/124 |
| D644,280 | S | 8/2011 | Marotta | |
| 8,323,127 | B2 | 12/2012 | Webb et al. | |
| 8,915,827 | B2 | 12/2014 | Cranke et al. | |
| 8,968,166 | B2 | 3/2015 | Cranke | |
| 9,186,536 | B2 * | 11/2015 | Strachan | A63B 21/0557 |
| 9,586,082 | B2 | 3/2017 | Cranke et al. | |
| 9,687,716 | B2 | 6/2017 | Geore | |
| 2002/0068667 | A1 * | 6/2002 | Strachan | A63B 21/0004 482/124 |
| 2005/0059537 | A1 | 3/2005 | Hull | |
| 2006/0265910 | A1 | 11/2006 | Lampley | |
| 2007/0060454 | A1 | 3/2007 | Vogel | |
| 2012/0283077 | A1 | 11/2012 | Cranke | |
| 2013/0143723 | A1 * | 6/2013 | Bender | A63B 21/0552 482/121 |
| 2013/0333097 | A1 | 12/2013 | Cranke et al. | |
| 2015/0057135 | A1 | 2/2015 | Cranke et al. | |
| 2016/0101309 | A1 | 4/2016 | Schreiber et al. | |
| 2017/0028244 | A1 | 2/2017 | Schreiber et al. | |

* cited by examiner

SPORTS TRAINING SYSTEM AND METHOD

CROSS-REFERENCE TO RELATED APPLICATIONS

This application claims the benefit of U.S. Provisional Patent Application 62/315,108 filed on Mar. 30, 2016, U.S. Provisional Patent Application 62/329,363 filed on Apr. 29, 2016, U.S. Provisional Patent Application 62/358,766 filed on Jul. 6, 2016, and U.S. Provisional Patent Application 62/437,441 filed on Dec. 21, 2016, all incorporated herein by reference.

STATEMENT REGARDING FEDERALLY SPONSORED RESEARCH AND DEVELOPMENT

Not Applicable.

FIELD OF THE INVENTION

This invention relates to sports training devices, and more particularly to a sports training device and method.

DISCUSSION OF RELATED ART

Exercise and physical training devices are replete in the prior art. With the advent relatively inexpensive and durable resistance band materials, resistance band exercising devices are becoming more popular. Several prior art resistance band exercising devices are disclosed in such prior art references as: US 2017/0028244 to Schreiber et al. on Feb. 2, 2017; US 2006/0265910 to Lampley on Nov. 30, 2016; and my previous patent applications 2013/0333097 published on Dec. 19, 2013; US 2012/0283077 Published on Nov. 8, 2011; US 2015/0057135 published on Feb. 26, 2015; and 2016/0101309 published on Apr. 14, 2016. None of these prior art devices teaches or suggests resistance that not only decreases as a person's leg retracts but that also can be set to cease or cut-off at a certain point in the travel of the leg, minimizing strain on ancillary or non-primary muscles. Further, none of the prior art devices allows for a wide range of connection points with the shoe that maximizes the number of different exercises and drills that can be performed. None of the prior art devices includes resistance adjustments both at the lower and upper ends of the resistance bands.

Therefore, there is a need for a physical training system that allows for the resistance applied to a person's legs to be reduced to zero at any adjustable point along the path of leg travel of the exerciser. Such a needed device would further allow a wide range of possible connection points between the person's torso and shoes, and would include adjustments for the length and resulting resistance between the top and bottom ends of each resistance band. The present invention accomplishes these objectives.

SUMMARY OF THE INVENTION

The present device is a physical training system for use by a person, such as an athlete or exerciser, that includes a belt adapted for fixing around the waist of the person. Preferably the belt includes a loop-type fastening material on both an inside surface and an outside surface thereof. A cooperative hook-type fastening material is fixed with the inside surface of the belt at a first end and an opposing second end. The belt also preferably includes a buckle mechanism adapted to receive the first and second ends, of the belt therethrough.

The belt includes a plurality of belt extension straps that each have a belt connecting mechanism at a top end thereof and a connection loop at a bottom end thereof. Each belt extension strap is adapted for fixing with the belt at any location therearound and preferably includes a length adjustment mechanism.

Two shoes are adapted for wearing on the person's feet, each shoe including at least four attachment loops at opposing quadrants of the shoe, and preferably a rear attachment loop and additional attachment loops around the inner and outer edges.

A plurality of elastomeric bands are selectively fixable between the connection loop of any of the belt extensions straps and the attachment loops of the shoes.

In preferred embodiments, the physical training system further includes a plurality of shoe extension straps each fixable at an upper end thereof with either end of any of the elastomeric bands, and selectively fixable at a lower end thereof with any of the attachment loops of either shoe. At least one of the shoe extension straps preferably further includes a second length adjustment mechanism.

As such, in use, with the person wearing the belt and shoes, and with the plurality of elastomeric bands stretched between the connection loops of the belt extensions straps and the attachment loops of the shoes, the person while walking or running experiences resistance as each leg extends into a fully extended position. Conversely, the person experiences a reduction or cessation of resistance as each leg retracts into a non-extended position.

Preferably each attachment loop of each shoe includes a strap member fixed at a lower end thereof with the shoe, preferably with a strap member attachment mechanism such as the hook-and-loop type fastening material, mechanical snaps, mechanical buckle mechanisms, or the like. An upper end of each strap member terminates in a loop that is adapted for selective fixing with an end of any of the elastomeric bands.

In some embodiments, the attachment loop and any associated strap member are color-coded so that the person knows which attachment loops to use for particular exercises. Further, a rigid metal or plastic ring may be included that traverses the connection loop of each belt extension strap for facilitating the connection of the connection loop with any of the elastomeric bands. In some embodiments, such a rigid ring may also be included traversing one or more of the attachment loops of each shoe. Preferably each end, of the elastomeric bands includes a selectively removable hook adapted for fixing with any of the attachment loops of the shoes, the connection loops of the belt extension straps, or the upper ends of the shoe extension straps.

In some embodiments the belt further includes a buckle cover having the hook-type fastening material on an inside surface thereof and adapted for fixing with the belt to cover the buckle mechanism. Such a buckle cover further includes the loop-type fastening material on an outside surface thereof, such that each belt extension strap may be fixed with the belt at the buckle cover, either on one side of the belt or another, or on both.

The present invention is a physical training system that allows for the resistance applied to a person's legs to be reduced to zero at any adjustable point along the path of leg travel of the exerciser. The present device further allows a wide range of possible connection points between the person's torso and shoes, and provides for adjustments to the length and resulting resistance between the top and bottom ends of each resistance band. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
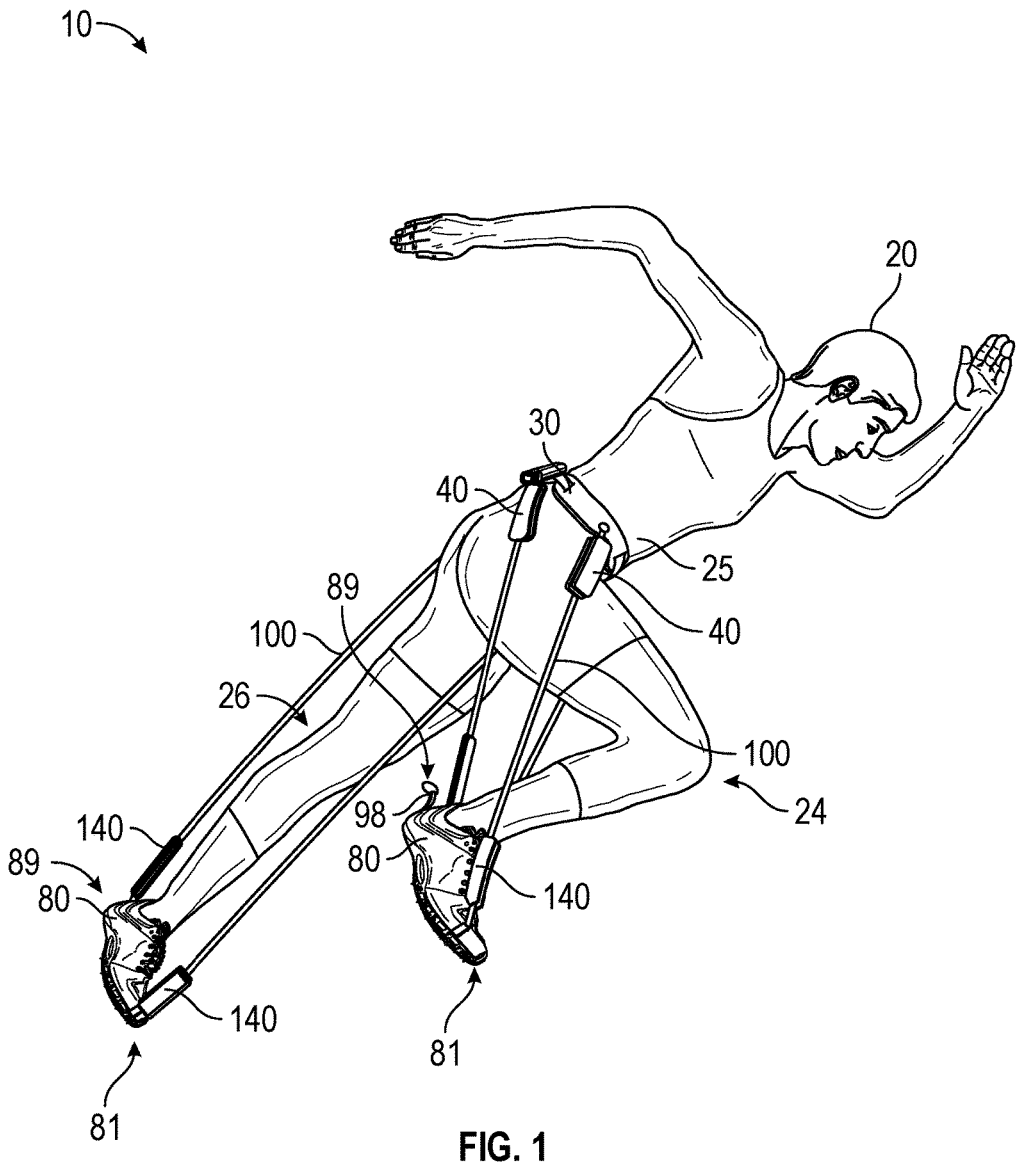
FIG. 1 is a side elevational view of the invention.
Figure 2:
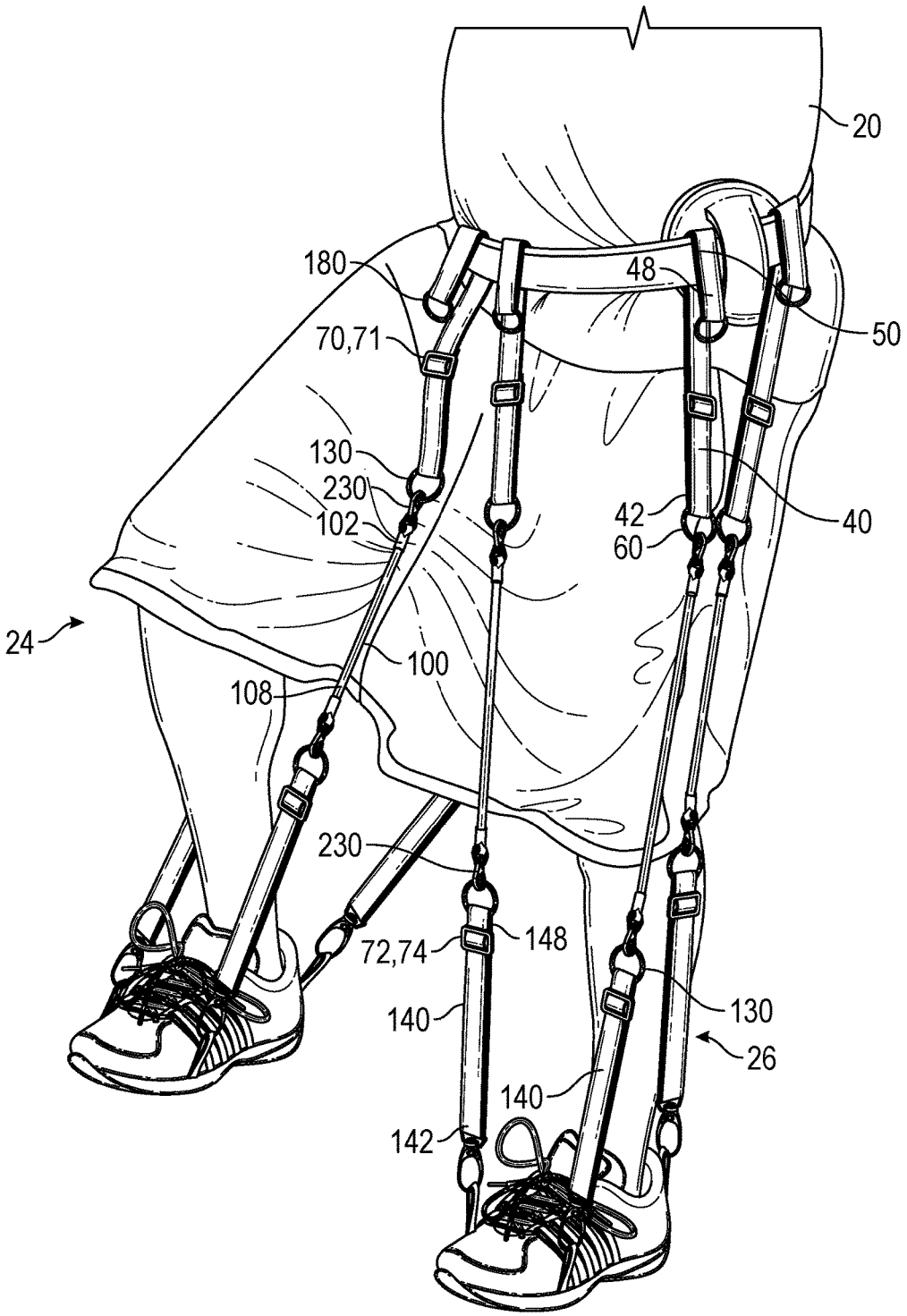
FIG. 2 is a perspective view of the invention.
Figure 3:
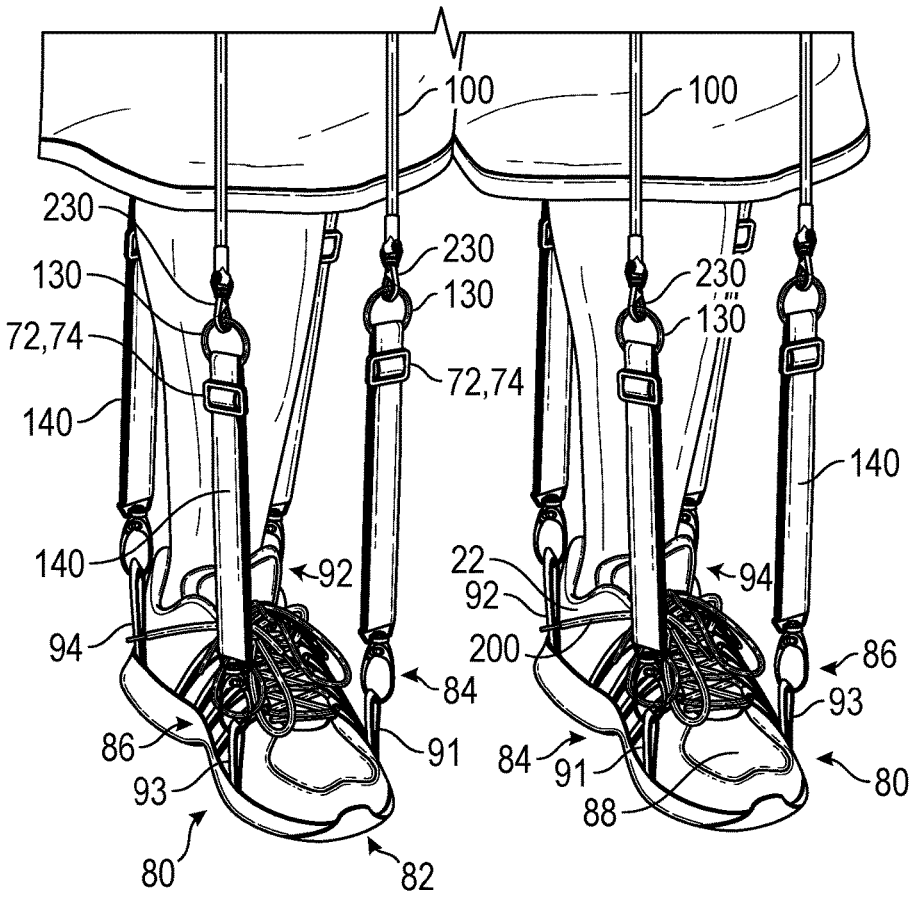
FIG. 3 is a front-perspective view of shoes and shoe extension straps of the invention.
Figure 4:
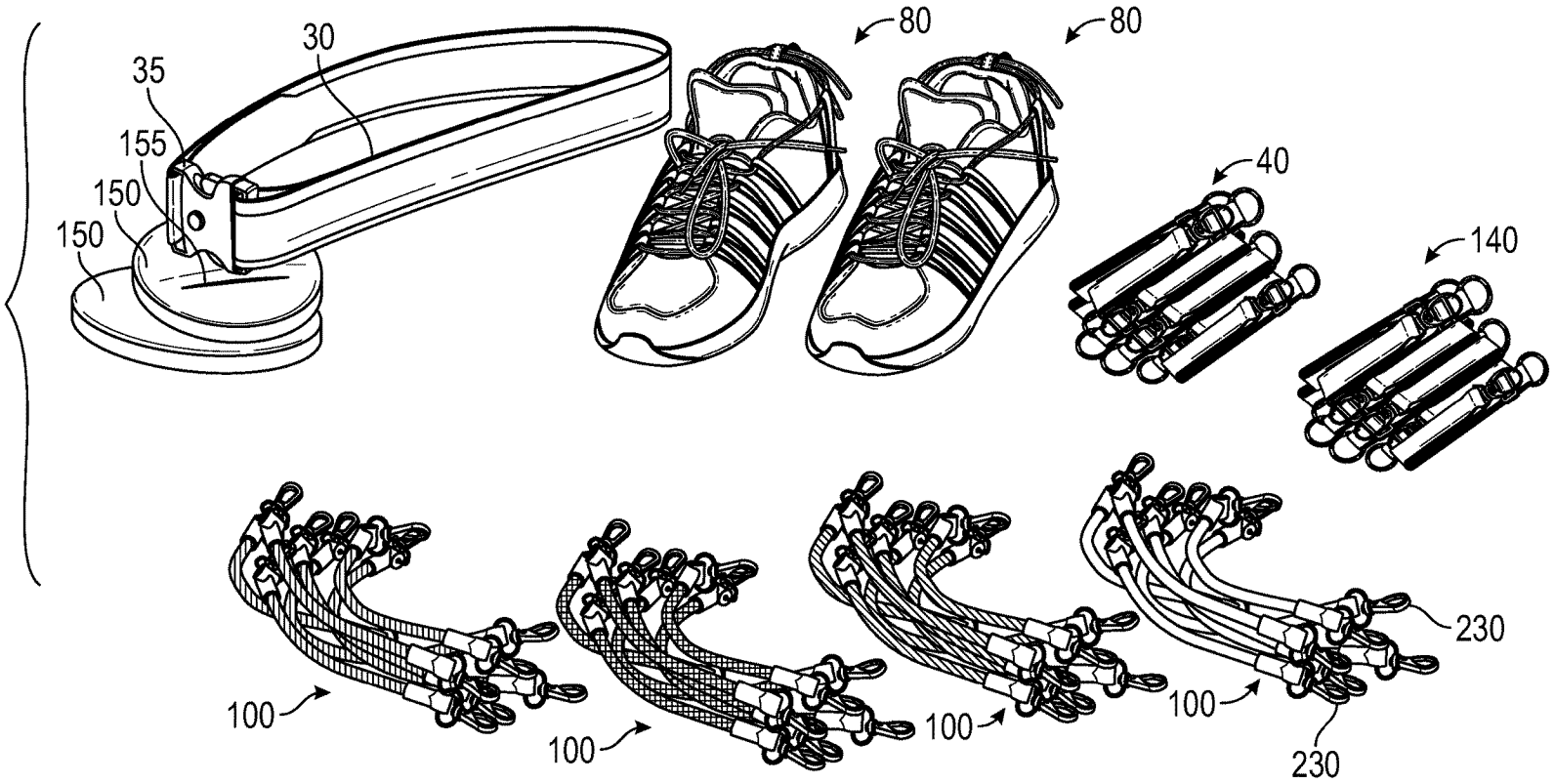
FIG. 4 is a perspective view of some of the component parts of the invention, resistance bands thereof shading for different colors.

FIGS. 1-3 illustrate a physical training system 10 for use by a person 20, such as an athlete or exerciser. The physical training system 10 provides additional resistance for lower body exercises such as walking, jogging, running, and various leg and balance exercises.

A belt 30 is adapted for fixing around the waist 25 of the person 20. The belt 30 is preferably resilient and includes an internal resilient stiffener 190 (FIG. 7) within an outer flexible nylon or polypropylene fabric or web sleeve 31 of the belt 30 to aid in maintaining the belt 30 in a circular shape while in-use. Alternately, the belt 30 is made from a resilient material such as a resilient plastic or rubber material.

Figure 5:
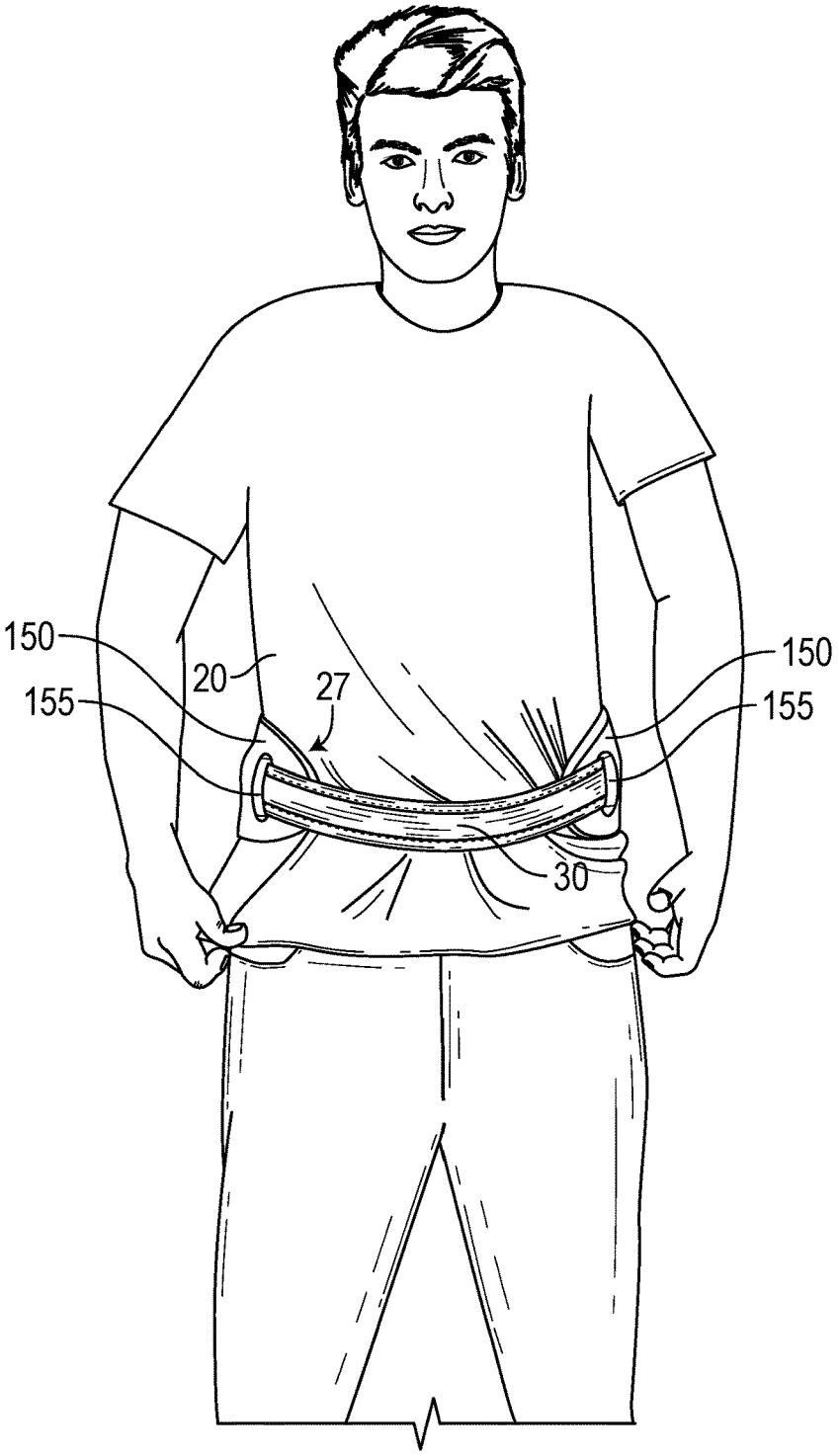
FIG. 5 is a front elevational view of a belt and hip pads of the invention.

Preferably the belt 30 further includes at least two hip pads 150 (FIG. 5) that each have a pair of vertical slots 155 adapted for receiving the belt 30 therethrough. As such, with the belt 30 inserted into each of the slots 155, each hip pad 150 may be adjusted to any location around the belt 30 to cushion forces on the person's hips 27 that pull down on the belt 30 during use. Such hip pads 150 are preferably made from a resilient foam material, or the like.

Preferably the belt 30 includes a loop-type fastening material 160 (FIG. 7) on both an inside surface 34 and an outside surface 36 thereof. A cooperative hook-type fastening material 170 is fixed with the inside surface 34 of the belt 30 at a first end 32 and an opposing second end 38. The belt 30 also preferably includes a buckle mechanism 35 adapted to receive the first and second ends 32,38 of the belt 30 therethrough. As such the person 20 may initially fit the belt around his waist 25 and then set the ends 32,34 of the belt 30 for a snug but comfortable fit. Thereafter the buckle mechanism 35 may be selectively separated mechanically to quickly unfasten or re-fasten the belt 30. As a person's waist size changes he can separate one or more of the ends 32,38 from the inside surface 34 of the belt 30 to make an adjustment to the diameter of the belt 30 around his waist 25.

Figure 7:
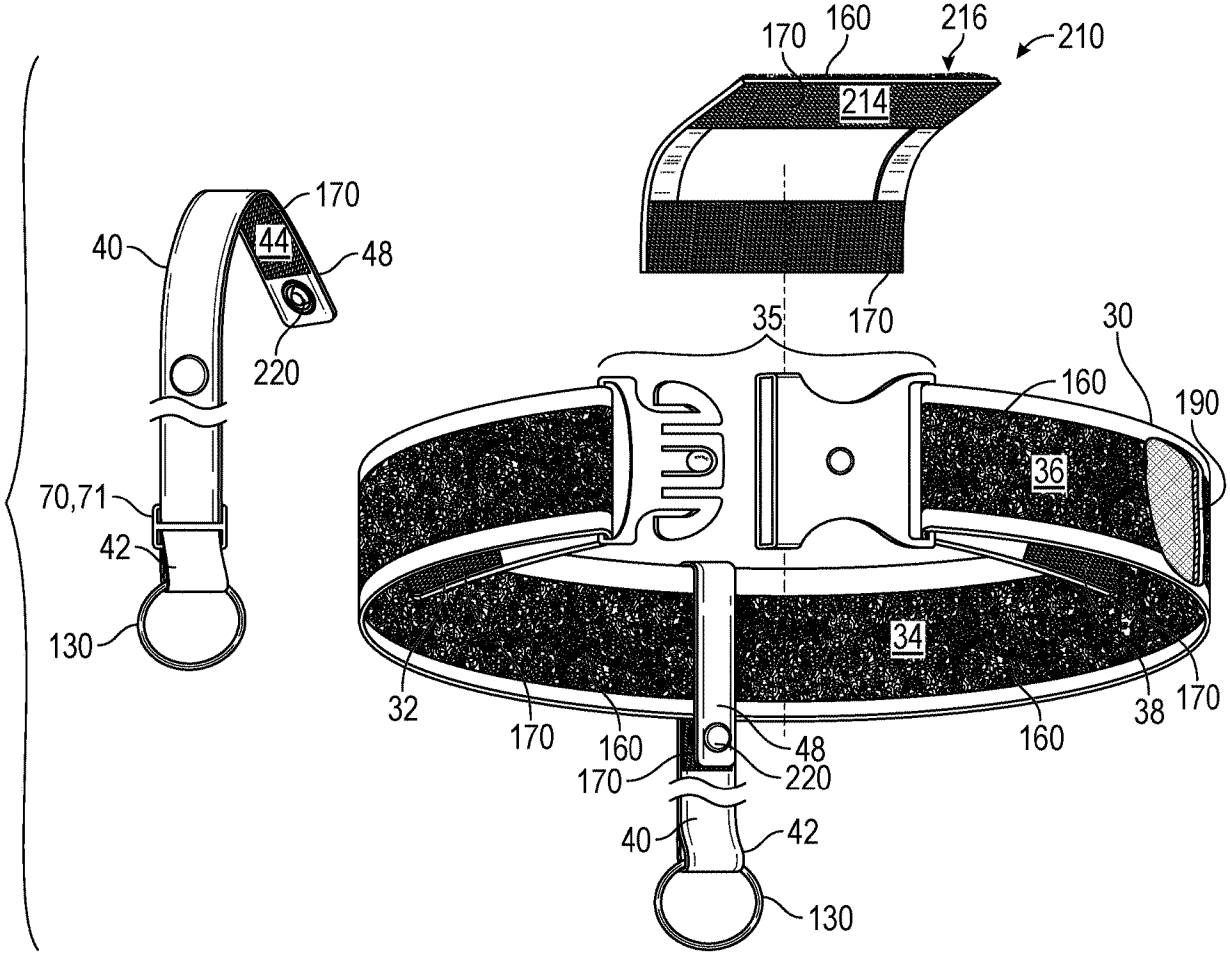
FIG. 7 is an exploded, partially cut-away perspective view of the belt and belt extension straps of the invention.

The belt 30 includes a plurality of belt extension straps 40 that each have a belt connecting mechanism 50 at a top end 48 of the belt 40 and a connection loop 60 at a bottom end 42 of the belt 40. Each belt extension strap 40 is adapted for fixing with the belt 30 at any location therearound and preferably includes a length adjustment mechanism 70, such as a buckle mechanism 71 (FIG. 2). The belt connecting mechanism 50 at the top end 48 of each belt extension strap 40 preferably includes the hook-type fastening material 170 on an inside surface 44 thereof, which is adapted for fixing about the loop-type fastening material 160 on the inside surface 34 and on the outside surface 36 of the belt 30 to fix the belt extension strap 40 at a desired location on the belt 30 (FIG. 7). Preferably each belt extension strap 40 is made from a nylon strap or webbing material, or the like.

In some embodiments of the invention, the belt 30 and any of the belt extension straps 40 may further include an auxiliary tension ring 180 fixed therewith, such that external lateral forces may be applied to the auxiliary tension ring 180 to further enhance the physical training of the person 20. For example, a coach may attach a strap or rope (not shown) to one or more of the auxiliary tension rings 180 to pull against the person 20 walking away from the coach.

Two shoes 80 are adapted for wearing on the person's feet 22, each shoe 80 including an outer side 86, an inner side 84, a rear end 89, a front end 81, a top side 88, and a bottom side 82. Each shoe 80 includes at least four attachment loops 90 that include an inner/front attachment loop 91 attached with the shoe 80 proximate the front end 81 of the shoe 80 on the inner side 84 thereof, an inner/rear attachment loop 92 attached with the shoe 80 proximate the rear end 89 of the shoe 80 on the inner side 84 thereof, an outer/front attachment loop 93 attached with the shoe 80 proximate the front end 81 of the shoe on the outer side 86 thereof, and an outer/rear attachment loop 94 attached with the shoe 80 proximate the rear end 89 of the shoe 80 on the outer side 86 thereof. Each shoe may further include a rear attachment loop 98, and other attachment loops 40 as necessary for providing multiple physical training options as discussed below. Such shoes 80 are preferably made with materials well-known in the art for running shoes, tennis shoes, track shoes, or the like. While the term "shoe" is used herein, it is understood that "shoe" could mean any type of footwear or article that is attached to footwear either permanently or temporarily. In some embodiments the shoe 80 can take the form of a shoe cover (not shown) that is worn over an existing shoe and that includes the attachment loops 90.

A plurality of elastomeric bands 100 each have a first end 102 and an opposing second end 108. The first end 102 of each elastomeric band 100 is selectively fixable with the connection loop 60 of any of the belt extensions straps 40. Similarly, the second end 108 of each elastomeric band 100 is selectively fixable with any of the attachment loops 90 of the shoes 80. Some of the elastomeric bands 100 may be made with different elasticities than other of the elastomeric bands 100, and preferably all elastomeric bands 100 having common elasticities have the same color, allowing the person 20 to easily differentiate between elastomeric bands 100 having different elasticities. Some of the elastomeric bands 100 may be made having different lengths (not shown) to accommodate people of different heights or ages. The elastomeric bands 100 are preferably made with an elastomeric rubber material, a coiled spring material, or the like.

In preferred embodiments, the physical training system 10 further includes a plurality of shoe extension straps 140 each fixable at an upper end 148 thereof with the second end 108 of any of the elastomeric bands 100, and selectively fixable at a lower end 142 thereof with any of the attachment loops 90 of either shoe 80. At least one of the shoe extension straps 140 preferably further includes a second length adjustment mechanism 72, such as a buckle mechanism 74 (FIGS. 2 and 7).

As such, in use, with the person wearing the belt 30 and shoes 80, and with the plurality of elastomeric bands 100 stretched between the connection loops 60 of the belt extensions straps 40 and the attachment loops 90 of the shoes 80, the person 20 while walking or running experiences resistance as each leg extends into a fully extended position 26. Conversely, the person 20 experiences a reduction or cessation of resistance as each leg retracts into a non-extended position 24.

Based on the exercise to be done, for example, jogging, the person 20 can adjust the belt extension straps 40 and shoe extension straps 140 such that the resistance bands 100 are just taut when the person's knee is at a top point in his stride. The front-most attachment loops 91,93 can be used to connect the resistance bands 100 with a forward part of the belt 30, and the rear-most attachment loops 92,94 can be used to connect the resistance bands 100 to a rearward part of the belt 30.

Alternately, for use with, for example, physical therapy applications, perhaps the resistance bands 100 and/or shoe extension straps 140 connect with the shoes 80 closer to a central location along the inner and outer sides 89,86 of the shoes 80, and the belt extension straps 40 and shoe extension straps 140 are adjusted such that the resistance bands 100 are just taut when the person's knee is only slightly raised. This would provide minimal resistance to those who are learning how to walk again after an accident, for example.

Alternately, for strenuous and rapid directional-changing exercises, such as the so-called "three-cone" drill performed by professional football players during practice, the person 20 can adjust the belt extension straps 40 and shoe extension straps 140 to tighten-up the resistance bands 100 to provide more resistance through a greater range of leg motion. For such an exercise the resistance bands 100 and/or shoe extension straps 140 connect with the shoes 80 closer to a central location of the shoe 80 along the inner and outer sides 89,86 thereof.

Preferably each attachment loop 90 of each shoe 80 includes a strap member 110 fixed at a lower end 112 thereof with the shoe 80, preferably with a strap member attachment mechanism 220 such as the hook-and-loop type fastening material 160,170, mechanical snaps, mechanical buckle mechanisms, or the like. An upper end 118 of each strap member 110 terminates in a loop 120 that is adapted for selective fixing with the second end 108 of any of the elastomeric bands 100. Such a plurality of strap members 110, when not in use for physical training of the person 20, may be cinched together with a conventional shoelace 200 to further aid in keeping the shoe 80 in place on the person's foot 22. Alternately, each strap member 110 may be fixed to the shoe with a two-part mechanical fastener (not shown) such as the hook-and-loop fastening material, magnets, mechanical snaps, or the like.

In some embodiments, the attachment loop 90 and any associated strap member 110 are color-coded so that the person 20 knows which attachment loops 90 to use for particular exercises. For example, the two attachment loops 90 closest to the front end 81 of each shoe 80 may be colored red, which in separate instructions (not shown) may indicate that such attachment loops 90 are used for exercises requiring flexion of the ankle and exercising of the calve and shin muscles, such as track workouts, box jumps, wide receiver routes, plyometric exercise, and the like. Alternately, the rear-most attachment loops 90 may be colored blue, which in separate instructions (not shown) may indicate that such attachment loops 90 are used for exercises requiring quick change of direction movement, such as quarter back drills, basketballs drills, so-called "three-cone" drills, and the like.

Preferably a rigid metal or plastic ring 130 traverses the connection loop 60 of each belt extension strap 40 for facilitating the connection of the connection loop 60 with any of the elastomeric bands 100. In some embodiments, such a rigid ring 130 may also be included traversing one or more of the attachment loops 90 of each shoe 80.

In some embodiments the belt 30 further includes a buckle cover 210 (FIG. 7) having the hook-type fastening material 170 on an inside surface 214 thereof and adapted for fixing with the belt 30 to cover the buckle mechanism 35. Such a buckle cover 210 further includes the loop-type fastening material on an outside surface 216 thereof, such that each belt extension strap 40 may be fixed with the belt 30 at the buckle cover 210, either on the inside surface 34 or on the outside surface 36 of the belt 30 separately, or on both surfaces 34,36 as shown with a folding buckle cover 210. Without such a buckle cover 210, the belt extensions straps 40 would not be easily affixed to the belt 30 at the location of the buckle mechanism 35 if such a location for one of the belt extension straps 40 was desired.

Figure 6:
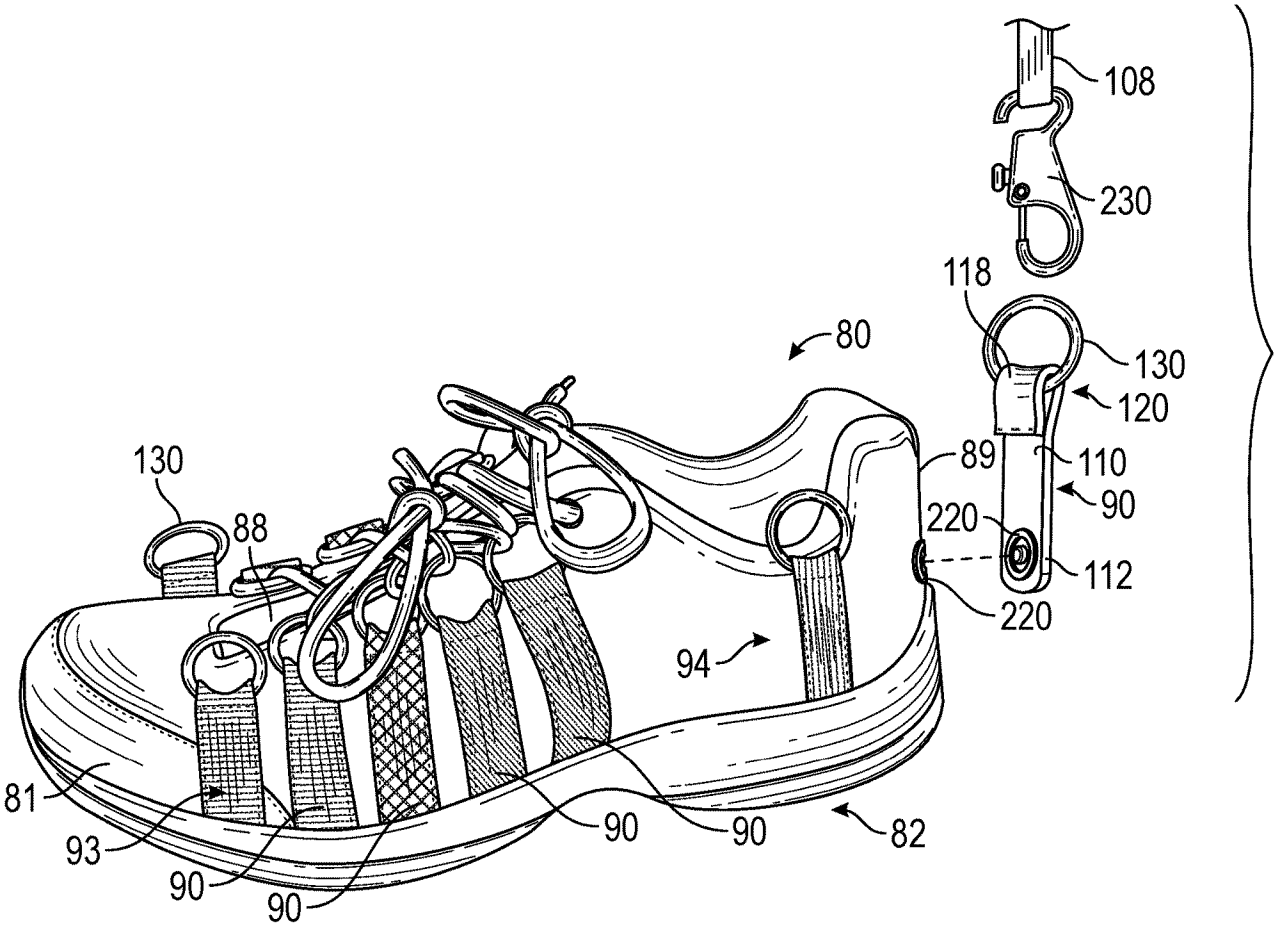
FIG. 6 is an exploded perspective view of one of the shoes of the invention.

Preferably each end 102,108 of the elastomeric bands 100 includes a selectively removable hook 230 (FIG. 6) adapted for fixing with any of the attachment loops 90 of the shoes, the connection loops 60 of the belt extension straps 40, or the upper ends 148 of the shoe extension straps 140. It is understood that either end 102,108 of the elastomeric bands 100 may be attached with any of the attachment loops 90, connection loops 60, or shoe extension straps 140; that is, the orientation of the elastomeric bands 100 does not affect how the system 10 is used.

While a particular form of the invention has been illustrated and described, it will be apparent that various modifications can be made without departing from the spirit and scope of the invention. For example, the buckle mechanism 35 of the belt 30 may be any other conventional belt mechanism as is known in the art and, while not as convenient to use as that described herein, would also function adequately to maintain the connection loops 60 at the height of the person's hips or waist 25. Likewise, various materials, colors and appearances of shoes 80 could be utilized as is known in the art. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A physical training system for use by a person, comprising:

a belt adapted for fixing around the waist of the person and including a plurality of belt extension straps each having a belt connecting mechanism at a top end thereof and a connection loop at a bottom end thereof, each belt extension strap adapted for fixing with the belt at any location therearound and including a length adjustment mechanism adapted for allowing the length of the belt extension strap to be selectively adjusted;

the belt including a loop-type fastening material on both an inside surface and an outside surface thereof, and a cooperative hook-type fastening material on an inside surface thereof at opposing first and second ends, the belt including a buckle mechanism adapted to receive the first and second ends of the belt therethrough, and wherein the belt connecting mechanism at the top end of each belt extension strap includes a hook-type fastening material on an inside surface thereof adapted for fixing about the loop-type fastening material on the inside surface and on the outside surface of the belt to fix the belt extension strap at a desired location on the belt;

two shoes adapted for wearing on the person's feet, each shoe including an outer side, an inner side, a rear end, a front end, a top side, and a bottom side, the shoe including at least four attachment loops, including an inner/front attachment loop attached with the shoe proximate the front end of the shoe on the inner side, an inner/rear attachment loop attached with the shoe proximate the rear end of the shoe on the inner side, an outer/front attachment loop attached with the shoe proximate the front end of the shoe on the outer side, and an outer/rear attachment loop attached with the shoe proximate the rear end of the shoe on the outer side;

a plurality of elastomeric bands each having a first end and a second end, the first end being selectively fixable with the connection loop of any of the belt extension straps, the second end being selectively fixable with any of the attachment loops of the shoes;

whereby with the person wearing the belt and shoes, and with the plurality of elastomeric bands stretched between the connection loops of the belt extension straps and the attachment loops of the shoes, the person while walking or running experiences resistance as each leg extends into a fully extended position, and experiences a reduction or cessation of resistance as each leg retracts into a non-extended position.

2. The physical training system of claim 1 wherein each attachment loop of each shoe includes a strap member fixed at a lower end thereof with the shoe and terminating at an upper end in a loop, each loop adapted for selective fixing with second end of any of the elastomeric bands.

3. The physical training system of claim 2 further including a rigid ring traversing each loop of each strap member, each rigid ring adapted for fixing with the second end of any of the elastomeric bands.

4. The physical training system of claim 2 wherein each attachment loop of each shoe is selectively attached to the shoe at the lower end of the strap member with a strap member attachment mechanism.

5. The physical training system of claim 2 wherein the strap member of each forward attachment loop is made from a material having a contrasting color to that of the strap member of each rear attachment loop.

6. The physical training system of claim 1 further including a plurality of shoe extension straps each fixable at an upper end thereof with the second end of any of the plurality of elastomeric bands, and selectively fixable at a lower end thereof with any of the attachment loops of either shoe.

7. The physical training system of claim 6 wherein each end of each elastomeric band includes a selectively removable hook adapted for fixing with any of the attachment loops of the shoes, any of the connection loops of the belt extension straps, and any of the upper ends of the shoe extension straps.

8. The physical training system of claim 6 wherein at least one of the shoe extension straps further includes a second length adjustment mechanism adapted for allowing the length of the shoe extension strap to be selectively adjusted.

9. The physical training system of claim 8 wherein the second length adjustment mechanism of the at least one shoe extension strap is a buckle mechanism.

10. The physical training system of claim 1 wherein the belt further includes at least two hip pads, each hip pad having a pair of vertical, parallel slots adapted for receiving the belt therethrough, whereby with the belt inserted into each of the slots the hip pad may be adjusted to any location around the belt to cushion forces pulling down on the belt onto the person's hips.

11. The physical training system of claim 1 wherein the plurality of elastomeric bands includes elastomeric bands having at least two different elasticities.

12. The physical training system of claim 1 wherein each belt extension further includes a rigid ring traversing each connection loop of each belt extension strap, each rigid ring adapted for fixing with the first end of any of the elastomeric bands.

13. The physical training system of claim 1 wherein each belt extension strap further includes an auxiliary tension ring fixed therewith, such that external lateral forces may be applied to the auxiliary tension ring to further enhance the physical training of the person.

14. The physical training system of claim 1 wherein the belt further includes an internal resilient stiffener, such that the belt retains a circular shape when in-use.

15. The physical training system of claim 1 wherein the attachment loops of each shoe may be fixed together to tighten the shoe around the person's foot with a conventional shoelace.

16. The physical training system of claim 1 wherein the belt further includes a buckle cover having the hook-type fastening material on an inside surface thereof and adapted for fixing with the belt to cover the buckle mechanism, and wherein the buckle cover further includes the loop-type fastening material on an outside surface thereof, whereby each belt extension strap may be fixed with the belt at the buckle cover.

17. The physical training system of claim 1 wherein each end of each elastomeric band includes a selectively removable hook adapted for fixing with any of the attachment loops of the shoes and any of the connection loops of the belt extension straps.

18. The physical training system of claim 1 wherein the length adjustment mechanism of the at least one belt extension strap is a buckle mechanism.

* * * * *